US008172212B2

(12) United States Patent
Lien et al.

(10) Patent No.: US 8,172,212 B2
(45) Date of Patent: May 8, 2012

(54) WEB PRODUCT FOLDING AND STACKING MACHINE, WEB PRODUCT FOLDING AND STACKING METHOD USING SAME

(75) Inventors: Hsin-Fa Lien, Taoyuan (TW); Cheng-Kuo Chen, Taoyuan (TW); Yen-Chih Chung, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 137 days.

(21) Appl. No.: 12/833,726

(22) Filed: Jul. 9, 2010

(65) Prior Publication Data

US 2011/0071010 A1 Mar. 24, 2011

(30) Foreign Application Priority Data

Sep. 21, 2009 (TW) ..... 98131793 A

(51) Int. Cl.
*B41L 1/32* (2006.01)
*B31F 1/08* (2006.01)

(52) U.S. Cl. ..... 270/39.02; 270/39.01; 270/39.05

(58) Field of Classification Search ..... 270/32, 270/39.01, 39.02, 39.05, 39.06, 41; 493/413, 493/418, 424, 430, 433, 451
See application file for complete search history.

(56) References Cited

U.S. PATENT DOCUMENTS

| | | | | |
|---|---|---|---|---|
| 4,770,402 | A * | 9/1988 | Couturier | 270/39.02 |
| 4,874,158 | A * | 10/1989 | Retzloff | 270/39.02 |
| 5,088,707 | A * | 2/1992 | Stemmler | 270/39.02 |
| 5,924,808 | A * | 7/1999 | Sides, II | 400/679 |
| 6,641,358 | B2 * | 11/2003 | Schmidt et al. | 414/801 |

* cited by examiner

*Primary Examiner* — Leslie A Nicholson, III
(74) *Attorney, Agent, or Firm* — Muncy, Geissler, Olds & Lowe, PLLC

(57) ABSTRACT

A web product folding and stacking machine includes two folding line making wheels, two folding fingers, a first carrier unit, a stoppage unit and a holder. The folding line making wheels and the folding fingers are operated to fold up web products on the first carrier unit to form a stack of interfolded web products. When a stack of a predetermined number of interfolded web products is finished, the stoppage unit is extended out to isolate the interfolded web products. Further, a retractable member of the stoppage unit is extended out to hold down the finished stack of interfolded web products when the stoppage unit is lowered to carry the finished stack of interfolded web products with the holder, keeping the finished stack of interfolded web products in integrity.

16 Claims, 16 Drawing Sheets

WEB PRODUCT FOLDING AND STACKING MACHINE, WEB PRODUCT FOLDING AND STACKING METHOD USING SAME

BACKGROUND OF THE INVENTION

1. Technical Field

The present invention relates to a folding machine, and more particularly to a web product folding and stacking machine, used for benefiting to keep the interfolded web products in integrity.

2. Description of the Prior Art

Please refer to FIG. 1. A conventional web product folding and stacking machine 10 is shown comprising two folding line making wheels 11, two folding fingers 13, a first carrier unit 15, a stoppage unit 17 and a holder 19. The two folding line making wheels 11 are rotatable in reversed directions to cause each web product 12 to form a folding line. The folding fingers 13 are adapted to stack up folded web product 12 on the first carrier unit 15 for enabling the web products 12 to be stacked up in an interfolded condition.

The stoppage unit 17 is adapted to isolate the interfolded web product 12, and the stoppage unit 17 and the holder 19 can be adapted to deliver the interfolded web product 12. When the stoppage unit 17 and the holder 19 are moved downwards, one web product 121 will be exposed to the outside of the stoppage unit 17. Normally, the length L of the stoppage unit 17 is smaller than the width L1 of the interfolded web products 12. Thus, the stoppage unit 17 cannot holds down the web product 121 entirely. When this situation occurs, the width L2 of the web product 121 that is exposed to the outside will be greater than the width L1 of the interfolded web products 12, resulting in unkempt stack of interfolded web products 12, as shown in FIG. 1A.

If the length L3 of the stoppage unit 17 is approximately equal to the width L1 of the interfolded web products 12, the stoppage unit 17 will be able to hold down one web product 121 that is exposed to the outside, enabling the width L2 of the exposed web product 121 to be approximately equal to the width L1 of the interfolded web products 12 after folding. Thus, interfolded web products 12 can be kept in integrity. However, when the length L3 of the stoppage unit 17 is increased, the extending stoppage unit 17 will pierce the web products 12. For example, the extending path R of the stoppage unit 17 will intersect with the web products 12 at the folding line making wheels 11 or the folding fingers 13, thereby damaging the structure of the web products 12, as shown in FIG. 1B.

SUMMARY OF THE PRESENT INVENTION

It is, therefore, the main object of the present invention to provide a web product folding and stacking machine, which has a retractable member mounted in the stoppage unit thereof and controllable to extend out of the stoppage unit to hold down interfolded web products effectively when the stoppage unit is moved to carry the finished interfolded web products downwards.

It is another object of the present invention to provide a web product folding and stacking machine, which has an air blower unit, which is adapted to blow air toward the web products at the stoppage unit, keeping the web product that exposed to the outside of the stoppage unit to be closely adhered to the top side of the stoppage unit.

It is another object of the present invention to provide a web product folding and stacking machine, which keeps the retractable member inside the stoppage unit when the stoppage unit extends and isolates interfolded web products, avoiding accidental damage to the interfolded web products.

It is still another object of the present invention to provide a web product folding and stacking machine, which has a flexible pad arranged on the top surface of the first carrier unit to impart an upward pressure to the web products stacked thereon so as to extend the contact time between the folding fingers and the stacked folded web products, facilitating making of a neat stack of interfolded web products.

It is still another object of the present invention to provide a web product folding and stacking machine, which has a suction device mounted in the first carrier unit for sucking one web product to have the web product be positively secured to the bottom surface of the first carrier unit.

It is another object of the present invention to provide a web product folding and stacking machine, which has a first folding unit and a second folding unit arranged below the first carrier unit and adapted to fold up the web product that suspends from the first carrier unit.

To achieve these and other objects of the present invention, a web product folding and stacking machine comprises two folding line making wheels arranged in proximity to each other for transferring web products and causing each web product to form a folding line thereon, two folding fingers adapted to fold up each web products along the folding line thereof for enabling the web products to be stacked up in an interfolded condition, a first carrier unit adapted to carry the web products folded by the folding fingers, a stoppage unit movable in a first direction and adapted to isolate interfolded web products, a retractable member mounted in said stoppage unit and movable in and out of said stoppage unit, and a holder being movable in the first direction and adapted to hold interfolded web products.

The invention further provides a web product folding and stacking method used in the web product folding and stacking machine. The method includes the steps of: forming a folding line on each of a plurality of web products and folding each web product on the first carrier unit immediately after formation of the folding line, operating said stoppage unit to isolate the interfolded web products when the number of the interfolded web products reaches a predetermined amount; moving said stoppage unit and said holder to deliver the interfolded web products to a predetermined location; and extending said retractable member out of said stoppage unit.

DETAILED DESCRIPTION OF THE PREFERRED EMBODIMENTS

Figure 1:
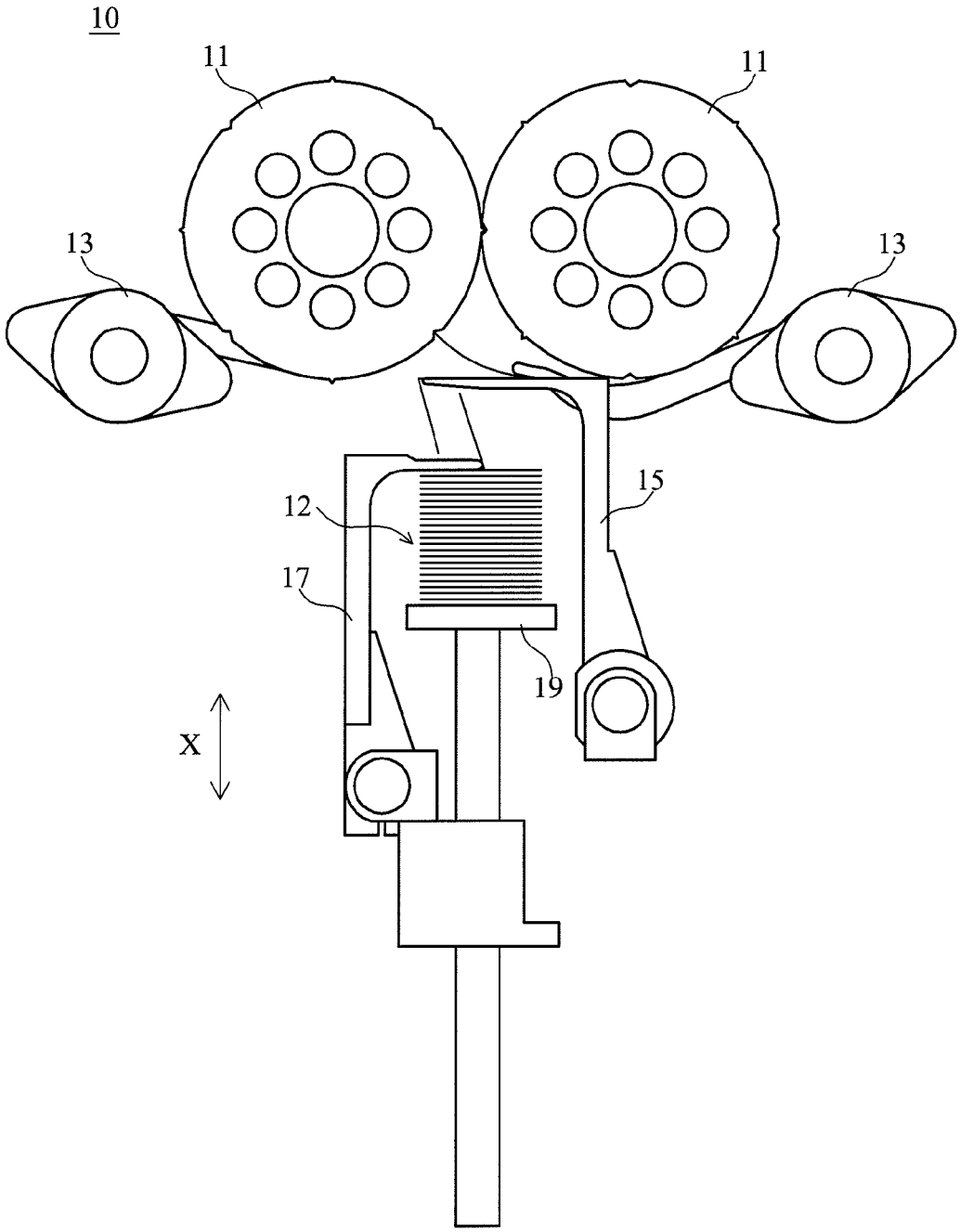
FIG.1 (PRIOR ART)
FIG. 1 is a schematic structural view of a web product folding and stacking machine according to the prior art.
Figure 1A:
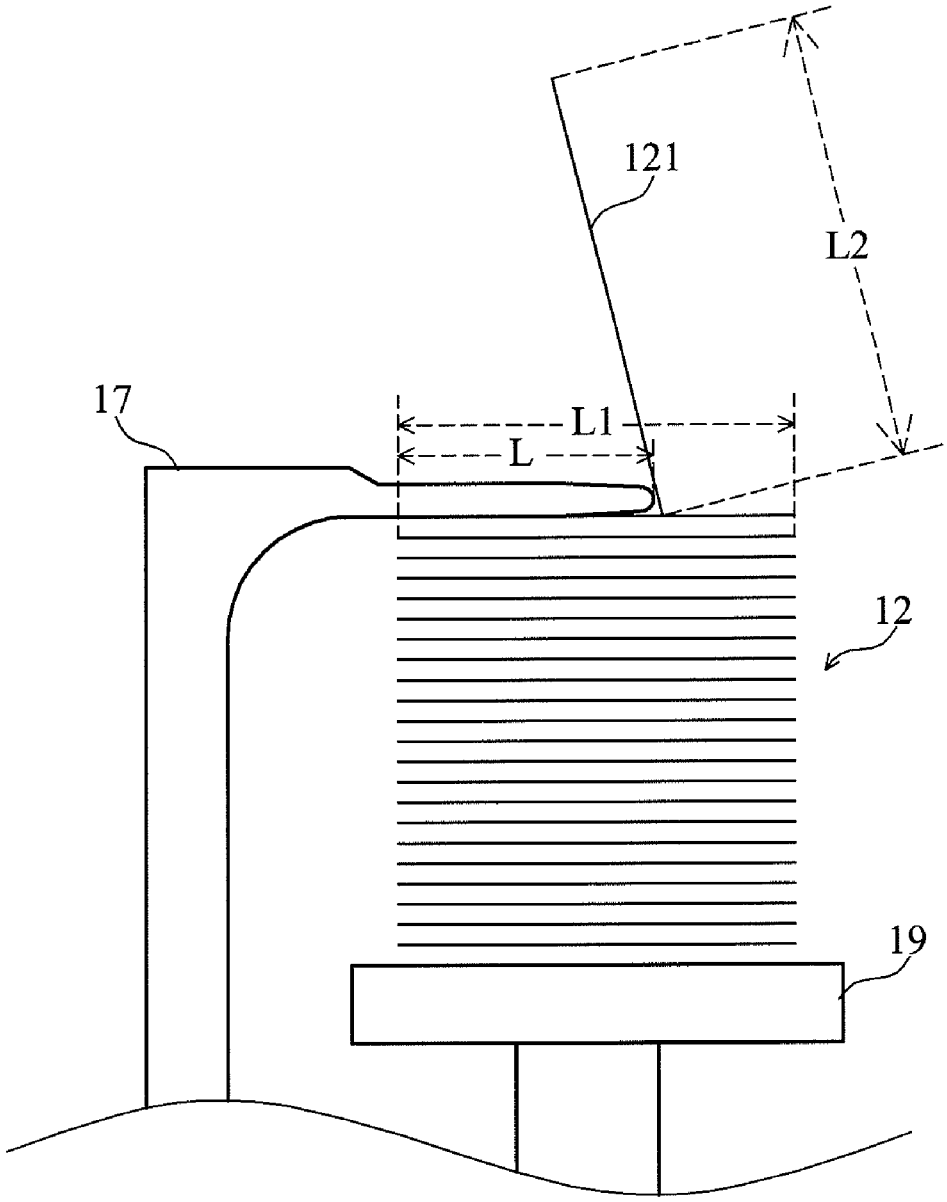
FIG.1A (PRIOR ART)
FIG. 1A is a schematic view of a part of the prior art design, showing the operation of the prior art web product folding and stacking machine.
Figure 1B:
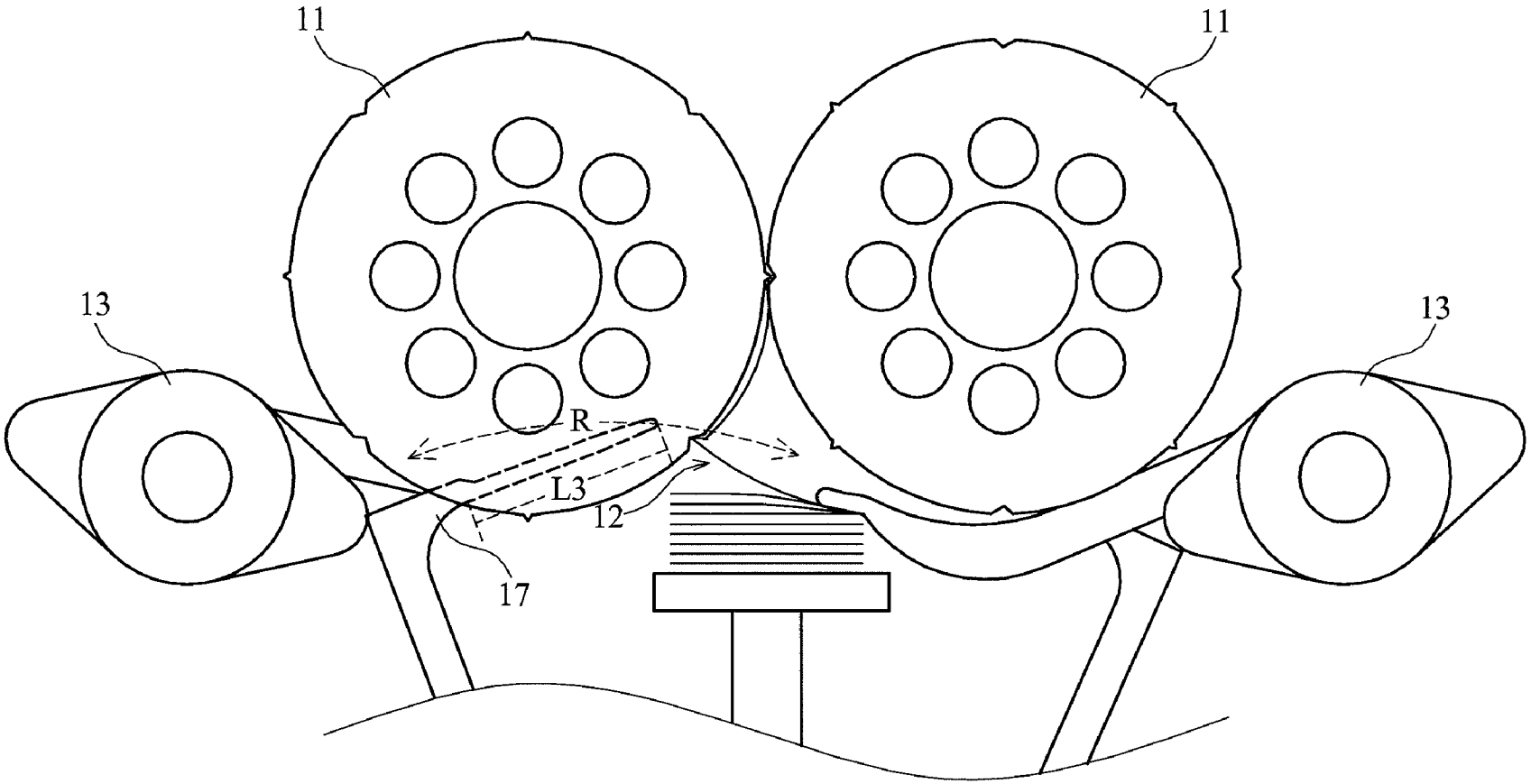
FIG. 1B (PRIOR ART)
FIG. 1B is a schematic view of another part of the prior art design, showing the operation of the prior art web product folding and stacking machine.
Figure 2:
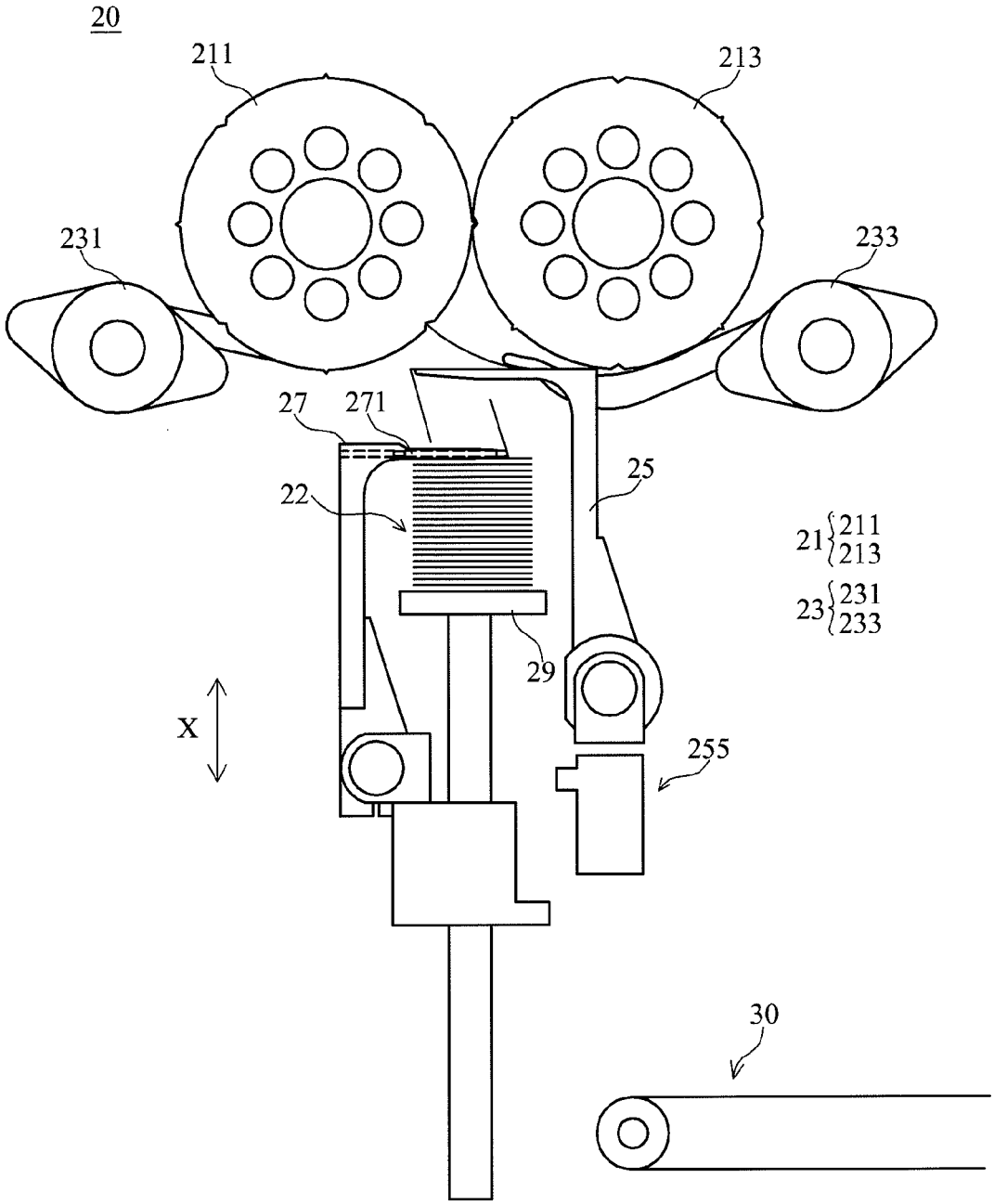
FIG. 2 is a schematic structural view of a web product folding and stacking machine in accordance with the present invention

Please refer to FIG. 2. A web product folding and stacking machine 20 in accordance with the present invention is shown comprising two folding line making wheels 21, two folding fingers 23, a first carrier unit 25, a stoppage unit 27 and a holder 29. Subject to the use of the web product folding and stacking machine 20, web products 22 can be folded and stacked up neatly.

The stoppage unit 27 has a retractable member 271 adapted to separate interfolded web products 22. In actual application, the amount of interfolded web products 22 can be known subject to the number of operation cycles of the folding fingers 23. When the number of interfolded web products 22 reaches the set value, the stoppage unit 27 is extended out to isolate the interfolded web products 22. The length of the stoppage unit 27 must be limited, for example, the length L of the stoppage unit 27 can be shorter than the width L1 of the interfolded web products 22, avoiding damage to the web products 22 by the outwardly extending stoppage unit 27. The holder 29 is adapted to hold the interfolded web products 22 and to match with the stoppage unit 27 for enabling the interfolded web products 22 to be delivered to a predetermined location.

Figure 2A:
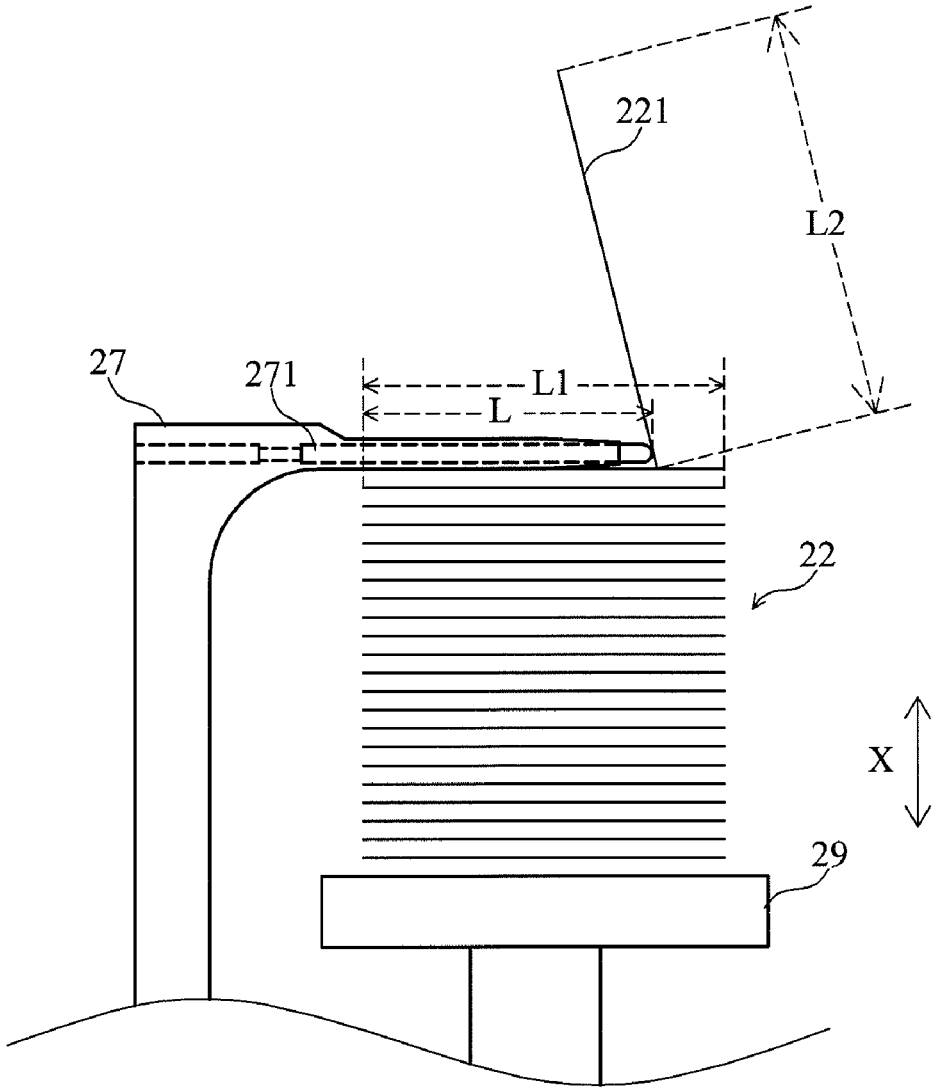
FIG. 2A is a schematic enlarged partial view of the web product folding and stacking machine in accordance with the present invention.

After extension of the stoppage unit 27 to separate interfolded web products 22, the stoppage unit 27 is moved with the holder 29 downwardly in the first direction X to a predetermined location. Because the length L of the stoppage unit 27 is shorter than the width L1 of the interfolded web products 22, the width L2 of the part of the web products 221 that is exposed to the outside of the stoppage unit 27 will be greater than the width L1 of the interfolded web products 22, thus, the web products 221 may be not neatly stacked up, as shown in FIG. 2A.

The retractable member 271 is movable in and out of the stoppage unit 27. According to this embodiment, the retractable member 271 is extended out after displacement of the stoppage unit 27, thereby extending the length of the stoppage unit 27. For example, after movement of the stoppage unit 27 with the holder 29 downwardly in the first direction X to a predetermined location, the retractable member 271 is extended out of the stoppage unit 27 slowly. It is to be understood that the retractable member 271 may be provided at the top or bottom side of the stoppage unit 27 and movable in and out of the stoppage unit 27.

Figure 2B:
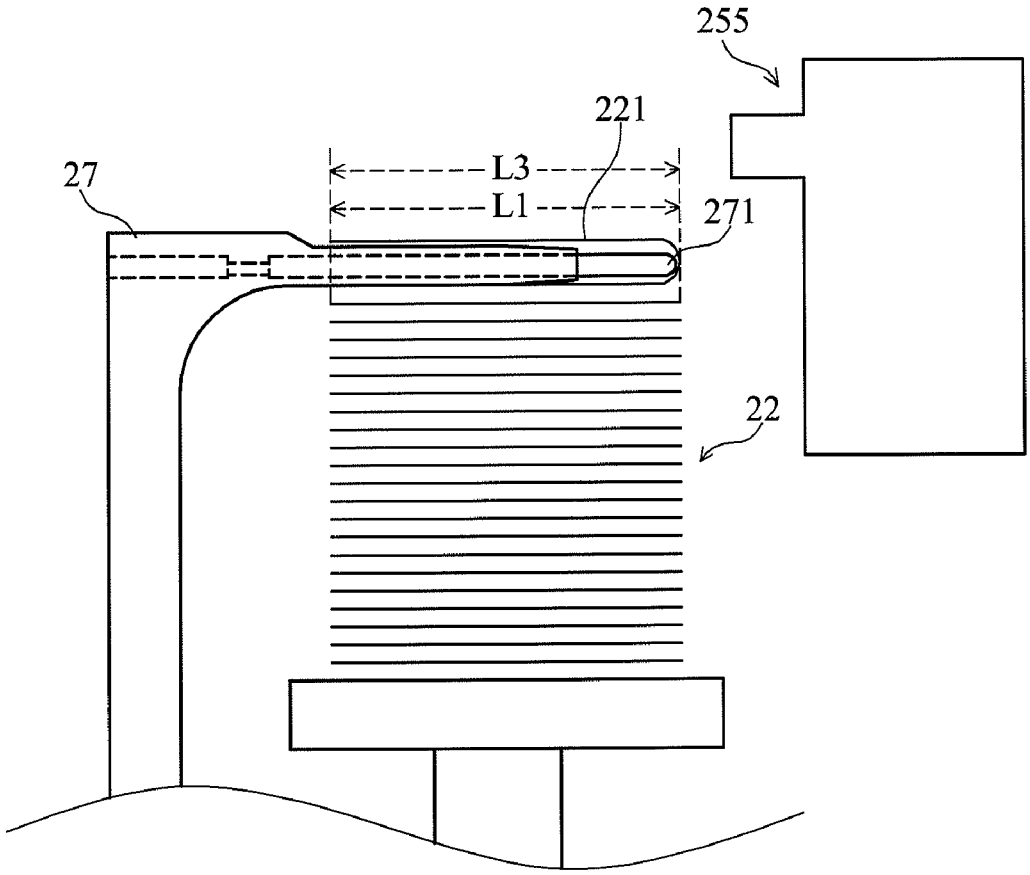
FIG. 2B is a schematic enlarged partial view of the web product folding and stacking machine in accordance with the present invention.

After movement of the retractable member 271 out of the stoppage unit 27, the length of the stoppage unit 27 is increased. At this time, the retractable member 271 can be pressed on the web product 221, causing the width L3 of the part of the web product 221 that is exposed to the outside of the stoppage unit 27 to become approximately equal to the width L1 of the interfolded web products 22, and therefore the web product 221 can be folded up and neatly stacked up. In another embodiment of the present invention, the web product folding and stacking machine 20 further comprises an air blower unit 255 controllable to blow air toward the part of the last piece of the interfolded web products 22 exposed to the outside of the stoppage unit 27, causing the last web product 22 to be folded on the stoppage unit 27. The air blower unit 255 can be, for example, arranged below the first carrier unit 25, as shown in FIG. 2B.

The two folding line making wheels 21 include a first folding line making wheel 211 and a second folding line making wheel 213, and rotatable in two reversed directions to cause each transferring web product 22 to form a folding line for folding and stacking. The two folding fingers 23 comprise a first folding finger 231 and a second folding finger 233 to fold up each web products 22 along the folding line thereof. For example, the folding line can be formed on the central line of web product 22. Further, the web products 22 can be toilet paper, facial tissues, paper towels, wet tissues or the like. Thus, a predetermined number of interfolded web products 22 can be packed in a commercial pop-up tissue box.

In one embodiment of the present invention, the stoppage unit 27 and the holder 29 are connected together and movable along the first direction X to deliver web products 22. For example, the holder 29 can be used to hold interfolded web products 22, enabling interfolded web products 22 to be delivered by the stoppage unit 27 and the holder 29 to a conveyer 30.

Figure 3:
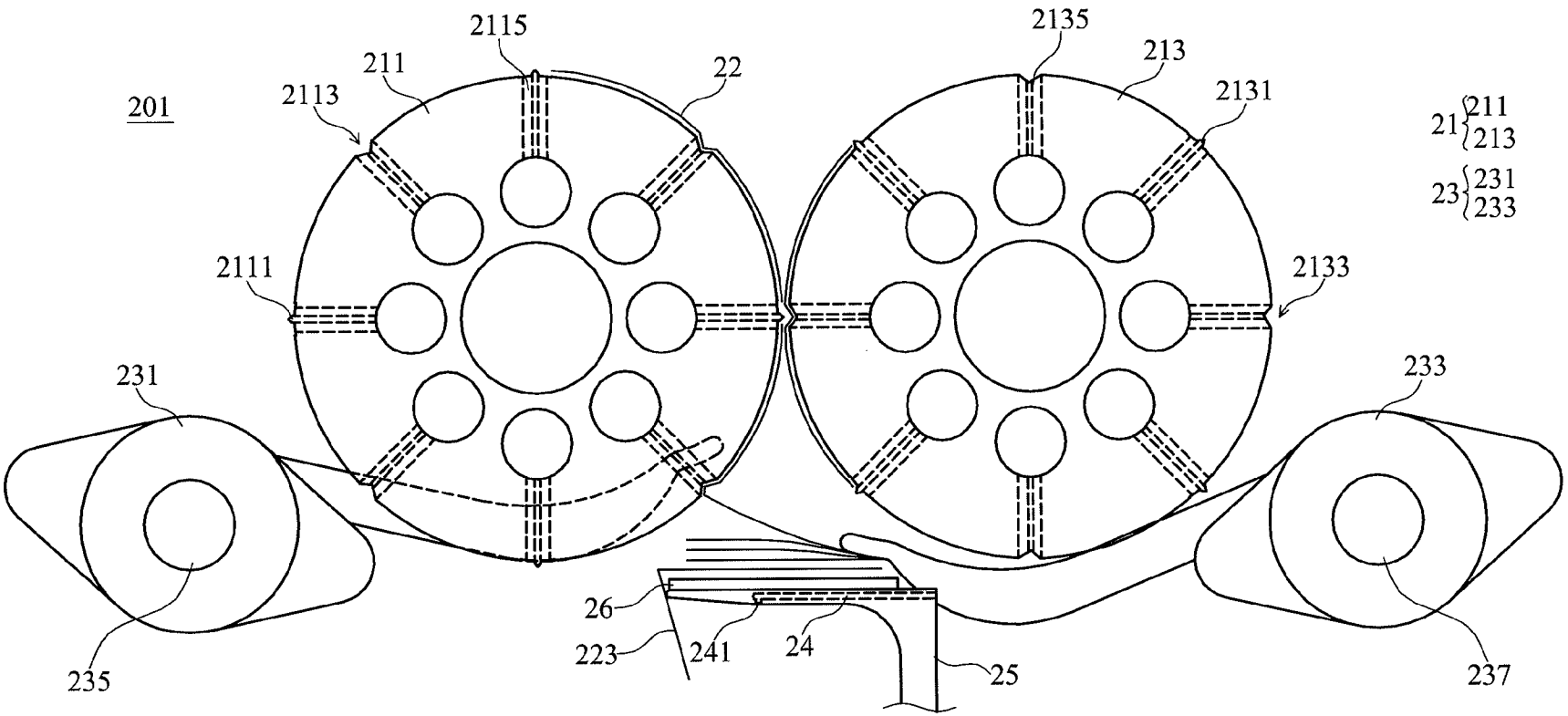
FIG. 3 is a schematic structural view of an alternate form of the web product folding and stacking machine in accordance with the present invention

FIG. 3 shows an alternate form of the web product folding and stacking machine in accordance with the present invention. According to this embodiment, the web product folding and stacking machine 201 comprises two folding line making wheels 21, two folding fingers 23, a first carrier unit 25, a stoppage unit 27 and a holder 29. By means of operating the web product folding and stacking machine 201, web products 22 can be interfolded neatly.

The folding line making wheels 21 include a first folding line making wheel 211 and a second folding line making wheel 213. The first folding line making wheel 211 has a plurality of longitudinal protrusions 2111 and a plurality of longitudinal grooves 2113 alternatively arranged around the periphery thereof. Similar to the first folding line making wheel 211, the second folding line making wheel 213 has a plurality of longitudinal protrusions 2131 and a plurality of longitudinal grooves 2133 respectively alternatively arranged around the periphery thereof.

The first folding line making wheel 211 and the second folding line making wheel 213 are arranged in a parallel manner in proximity to each other such that the longitudinal protrusions 2111 of the first folding line making wheel 211 can be engaged into the longitudinal grooves 2133 of the second folding line making wheel 231; the longitudinal protrusions 2131 of second folding line making wheel 213 can be engaged into the longitudinal grooves 2113 of the first folding line making wheel 211. The first folding line making wheel 211 and the second folding line making wheel 213 are rotatable in reversed directions, for example, the first folding line making wheel 211 is rotatable in clockwise direction and the second folding line making wheel 213 is rotatable in counter clockwise direction. When one web product 22 is being transferred through the gap in between the first folding line making wheel 211 and the second folding line making wheel 213 during rotation of the first folding line making wheel 211 and the second folding line making wheel 213 in reversed directions, the web product 22 will be squeezed by one longitudinal protrusion 2111 or 2131 of the first folding line making wheel 211 or second folding line making wheel 213 and one corresponding longitudinal groove 2133 or 2113 of the second folding line making wheel 213 or first folding line making wheel 211, thereby causing formation of a folding line on the web product 22.

Figure 3A:
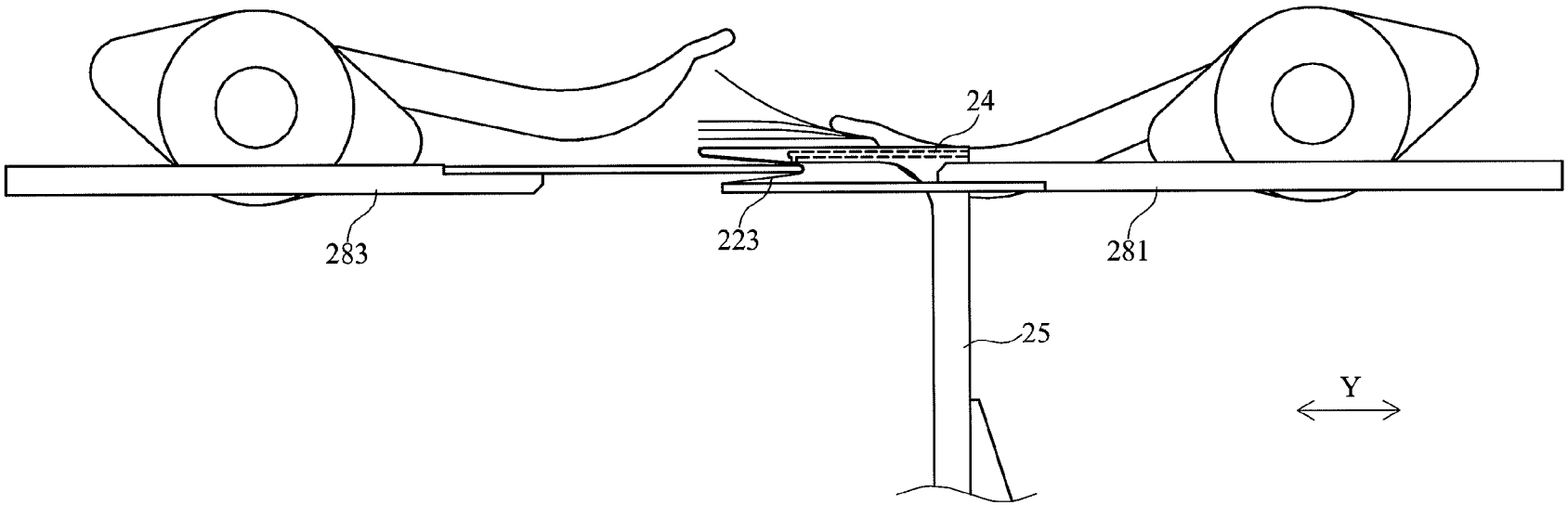
FIG. 3A is a schematic enlarged partial view of the alternate form of the web product folding and stacking machine in accordance with the present invention.

Suction holes 2115 and 2135 are respectively formed in the first folding line making wheel 211 and the second folding line making wheel 213 corresponding to the respective longitudinal protrusions 2111 and 2131 and the respective longitudinal grooves 2133 and 2113 for sucking in air such that the folding line making wheels 21 can suck or release the web product 22. Further, the folding fingers 23 include a first folding finger 231 and a second folding finger 233 respectively pivotally supported on a respective pivot member 235 or 237 at a lower elevation relative to the folding line making wheels 21. Thus, the first folding finger 231 and the second folding finger 233 can be turned about the respective pivot member 235 or 237 within a predetermined angle to fold the web product 22 along its folding line, as shown in FIG. 3A.

Further, the first carrier unit 25 has a pad 26 arranged on the top surface 251 thereof for carrying the web products 22 that are interfolded by the folding line making wheels 21 and the folding fingers 23 in a stack. Further, when the thickness of interfolded web products 22 reaches a certain extent, the first carrier unit 25 will be lowered slowly in the first direction X. The pad 26 is made from an elastic material. For example, the pad 26 can be made from rubber, silicon rubber, sponge, paper sheet or cloth that is capable of imparting an upward return force F to the web product 22 and/or the folding fingers 23 during downward stroke of the folding fingers 23, thereby extending the contact time between the folding fingers 23 and the respective web product 22 and facilitating accurate stacking of the interfolded web products 22.

The first carrier unit 25 is adapted to hold web products 22, therefore the first carrier unit 25 is not deformable. If only a limited number of web products 22 has been stacked on the first carrier unit 25, the web products 22 cannot provide sufficient upward return force F to the folding fingers 23, the contact time between the folding fingers 23 and the newly fed web product 22 will be short, causing flying of the web products 22 during folding and resulting in poor alignment of the stacked web product 22 on the first carrier unit 25.

The first carrier unit 25 further has a suction device 24 arranged thereon. The suction device 24 has a nozzle hole 241 located on the bottom surface 253 of the first carrier unit 25 for sucking in air, thereby securing a web product 221.

Figure 3B:
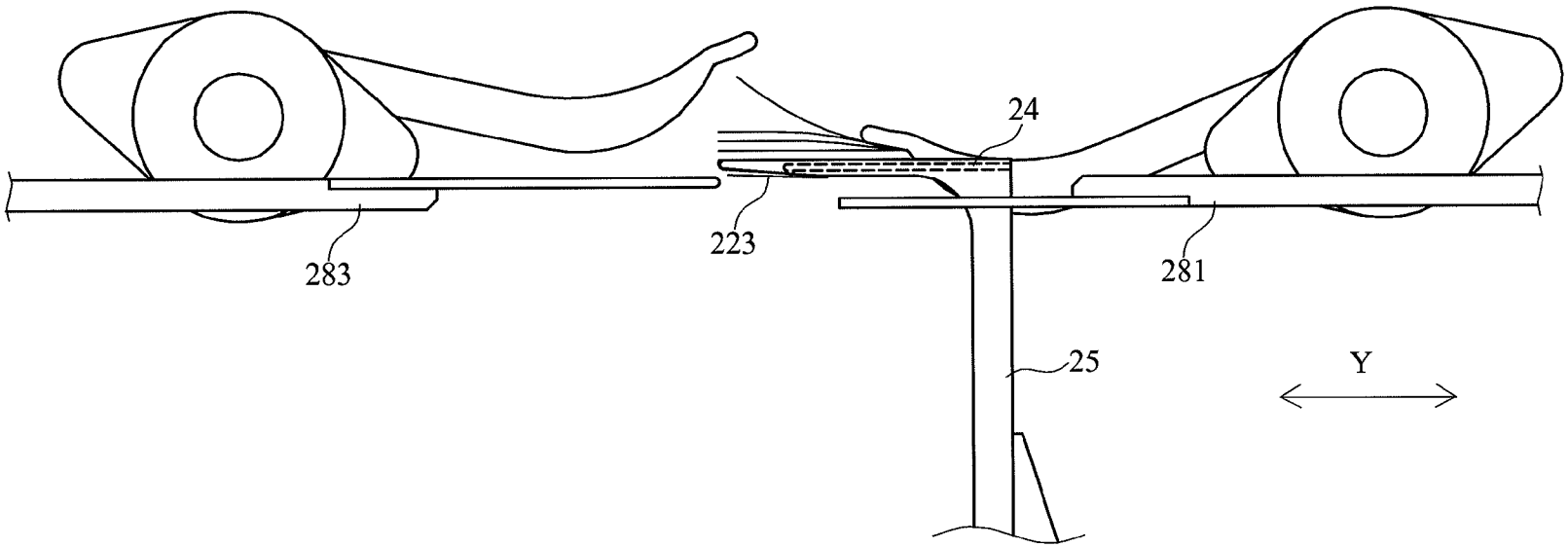
FIG. 3B is a schematic enlarged partial view of the alternate form of the web product folding and stacking machine in accordance with the present invention.

In one embodiment of the present invention, the web product folding and stacking machine comprises a first folding unit 281 and a second folding unit 283 adapted to fold up the web product 223 suspending from the first carrier unit 25. The first folding unit 281 and the second folding unit 283 can be arranged at different elevations. An overlap region is formed when the first folding unit 281 and the second folding unit 283 are being moved toward each other in a second direction Y perpendicular to the first direction X, thereby folding up the web product 223 that suspends from the first carrier unit 25, as shown in FIG. 3A. When the first folding unit 281 and the second folding unit 283 are moved apart, the suction device 24 sucks the folded web product 221, thereby securing the folded web product 223 to the bottom surface 253 of the first carrier unit 25, as shown in FIG. 3B.

Normally, the first folding unit 281 and the second folding unit 283 are controlled to fold up the web product 22 at one quarter from the edge, and the user can conveniently pup up the first (top) piece of a stack of interfolded web products.

Figure 4A:
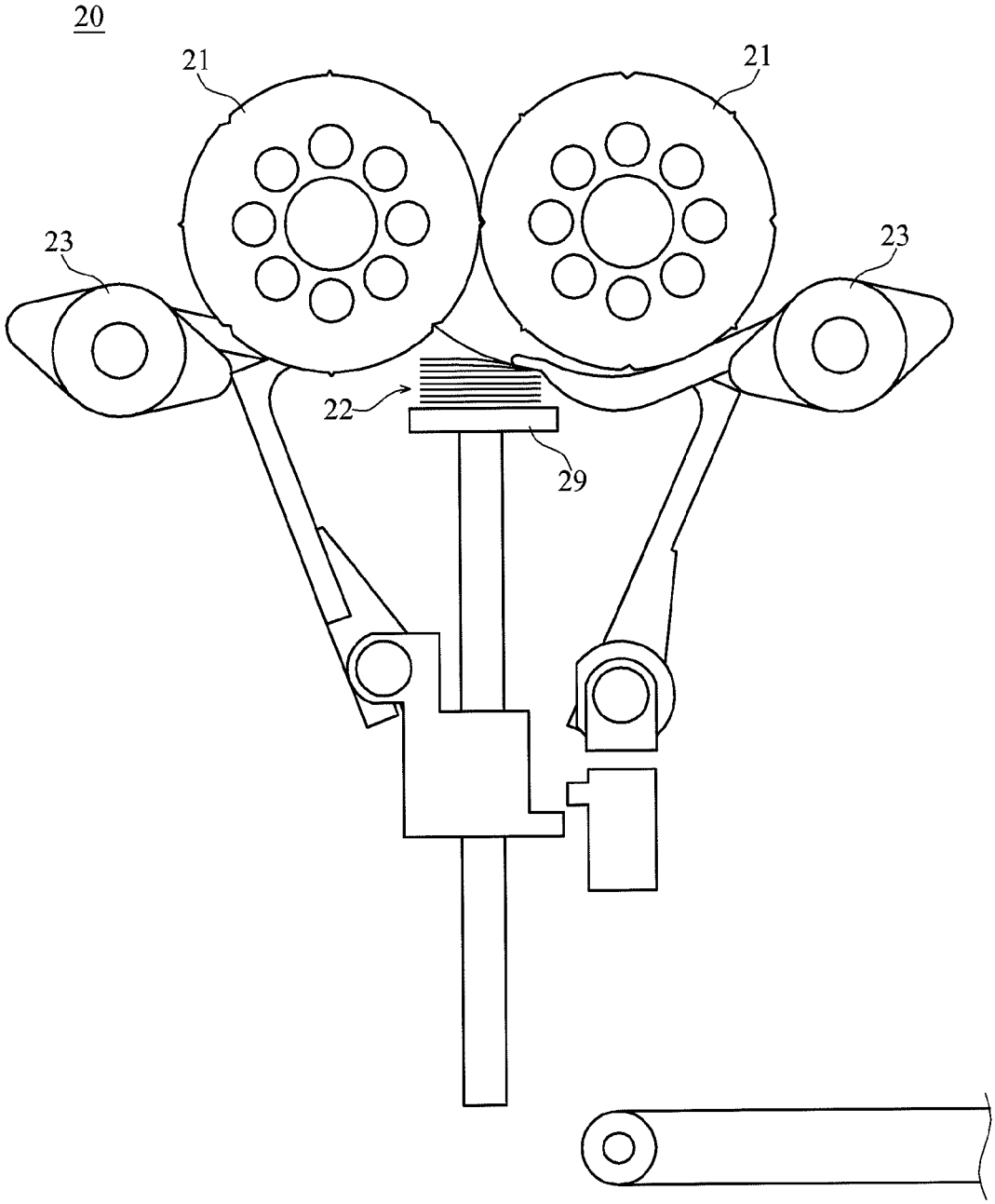
FIG. 4A~4G illustrate the operation flow of the web product folding and stacking machine in accordance with the present invention.

FIGS. 4A through 4G illustrate the operation of the web product folding and stacking machine 20. When the web product folding and stacking machine 20 is started, the holder 29 is moved to a predetermined position, and then the folding line making wheels 21 and the folding fingers 23 are operated to fold web products 22 into a stack of interfolded web products 22 on the holder 29, as shown in FIG. 4A.

When the number of the interfolded web products 22 on the holder 29 reaches a predetermined quantity, the stoppage unit 27 is extended out to isolate the interfolded web products 22, and then the stoppage unit 27 is moved with the interfolded web products 22 and the holder 29 in the first direction X to a predetermined location for delivery.

Figure 4B:
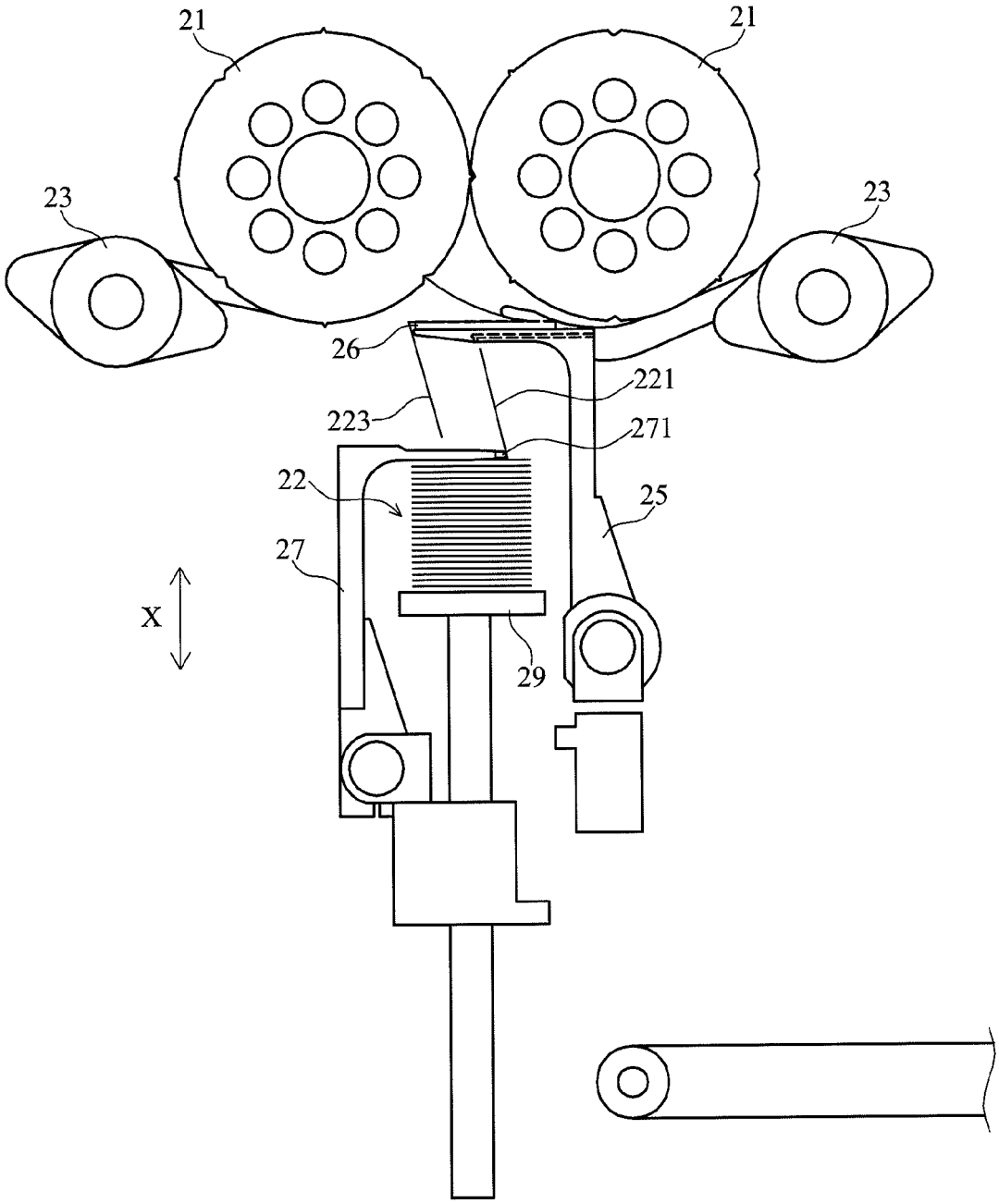

When the stoppage unit 27 and the holder 29 are started to deliver the interfolded web products 22, the retractable member 271 of the stoppage unit 27 is extended out. Further, when the stoppage unit 27 is extended out, the first carrier unit 25 is simultaneously extended out. The first carrier unit 25 has the pad 26 mounted thereon. Thus, the folding line making wheels 21 and the folding fingers 23 can continuously fold up web products 22 on the pad 26 at the first carrier unit 25 after finish of one stack of interfolded web products 22 on the holder 29, as shown in FIG. 4B.

Further, as stated above, the pad 26 is arranged on the first carrier unit 25 at the top side and has an elastically deformable characteristic. When only a limited number of web products 22 has been stacked up on the pad 26, the pad 26 can impart an upward return force F through the web products 22 to the folding fingers 23, thereby effectively extending the contact time between the folding fingers 23 and the web products 22 to facilitate formation of a neat stack of interfolded web products 22.

During delivery of the finished stack of interfolded web products 22 by the stoppage unit 27 and the holder 29 in the first direction X, the finished stack of interfolded web products 22 is separated from the first carrier unit 25, and one web product 221 will be exposed to the outside of the stoppage unit 27 and another web product 223 will suspend from the first carrier unit 25. The stoppage unit 27 comprises a retractable member 271. When the stoppage unit 27 and the holder 29 are moved in the first direction X to deliver web products 22, the retractable member 271 is extended out of the stoppage unit 27.

Figure 4C:
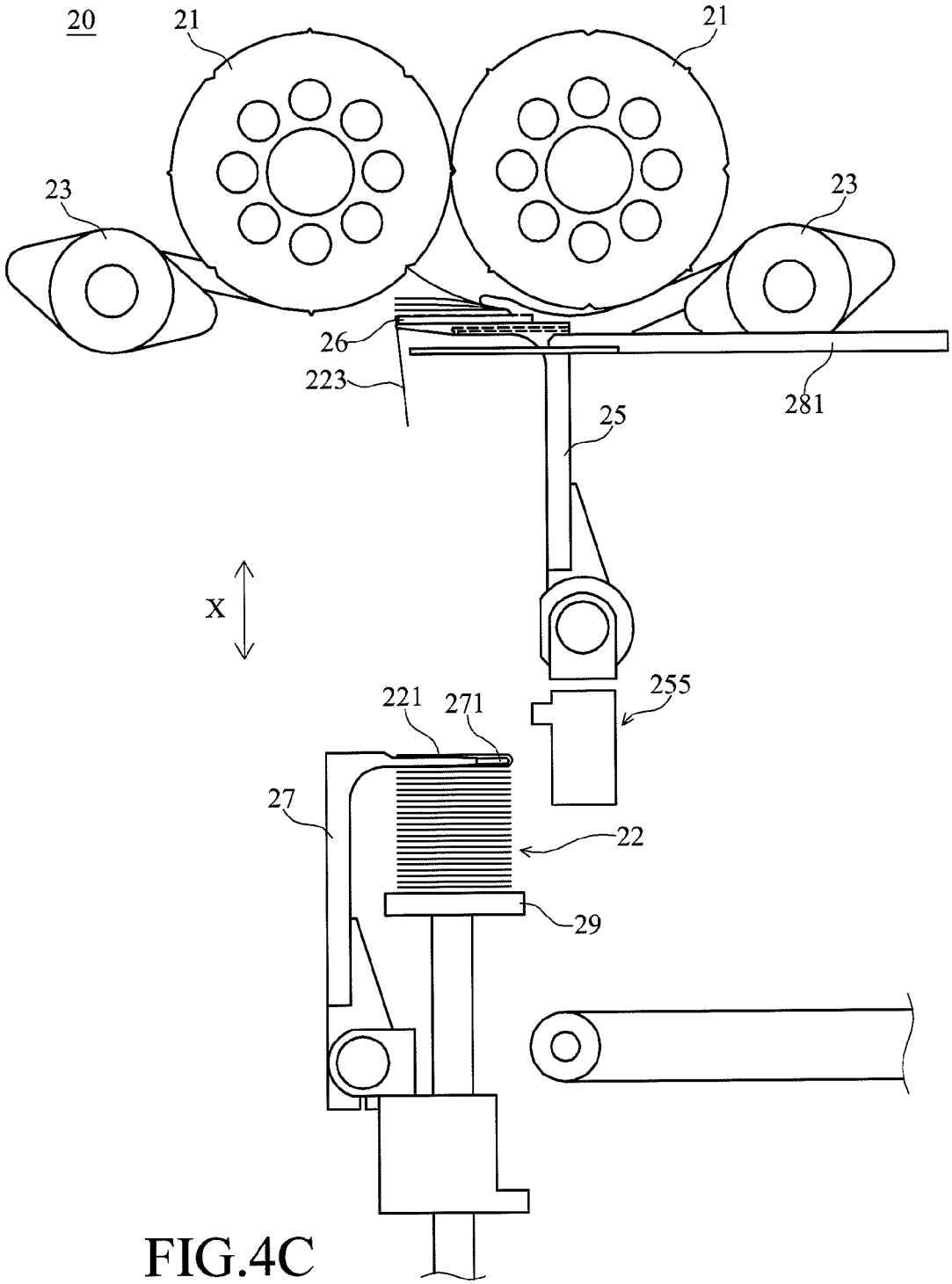

The folding line making wheels 21 and the folding fingers 23 keep operating to make another stack of interfolded web products 22, and the first folding unit 281 that is arranged below the first carrier unit 25 will be extended out slowly. Following increasing of the thickness of the interfolded web products 22 being stacked on the first carrier unit 25, the first carrier unit 25 will be lowered along the first direction X. The web product folding and stacking machine 20 further comprises an air blower unit 255 adapted to blow air toward the web product 221 above the stoppage unit 27, enabling the web product 221 to be folded on the stoppage unit 27, as shown in FIG. 4C.

Figure 4D:
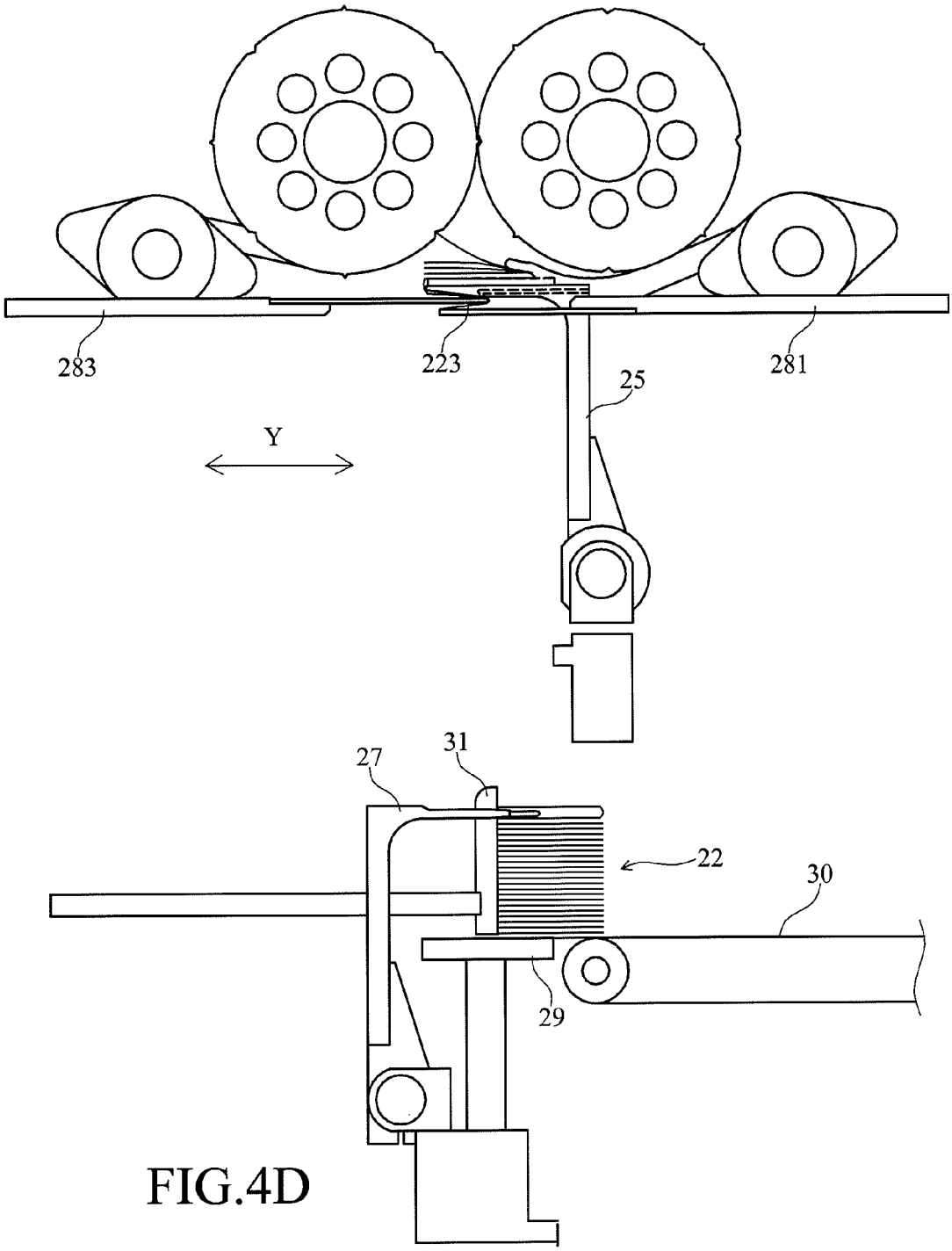

After extension of the first folding unit 281, the second folding unit 283 which is disposed between the first carrier unit 25 and the first folding unit 281 is extended out. The first folding unit 281 and the second folding unit 283 are movable in the second direction Y that is perpendicular to the first direction X. When the second folding unit 283 and the first folding unit 281 are overlapped, the suspending web product 223 is folded up on the first carrier unit 25. The extending order of the first folding unit 281 and the second folding unit 283 may be changed, or both the first folding unit 281 and the second folding unit 283 can be extended out at the same time. Further, after delivery of interfolded web products 22 to a predetermined location by the stoppage unit 27 and the holder 29, a push unit 31 is operated to push the interfolded web products 22 away from the holder 29 to the conveyer belt 30 for further delivery, as shown in FIG. 4D.

Figure 4E:
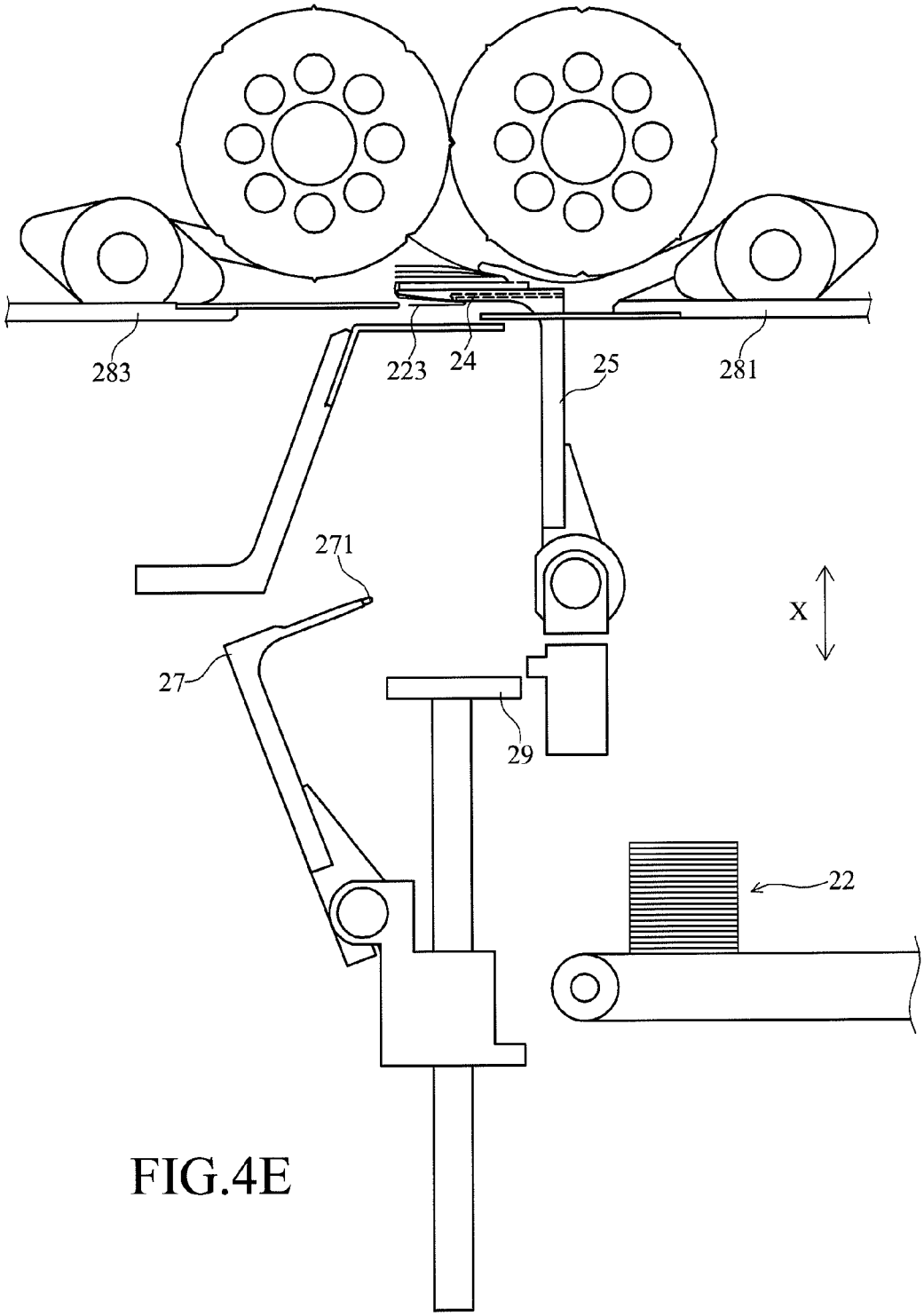

After folding of web product 223, the first folding unit 281 and the second folding unit 283 are retracted slowly. Moreover, the suction device 24 at the first carrier unit 25 is operated to suck the folded web product 223. After delivery of the interfolded web products 22, the stoppage unit 27 and the holder 29 are moved upwards in the first direction X, and the retractable member 271 is retracted inside the stoppage unit 27, facilitating the stoppage unit 27 to perform a next web product separation operation, as shown in FIG. 4E.

Figure 4F:
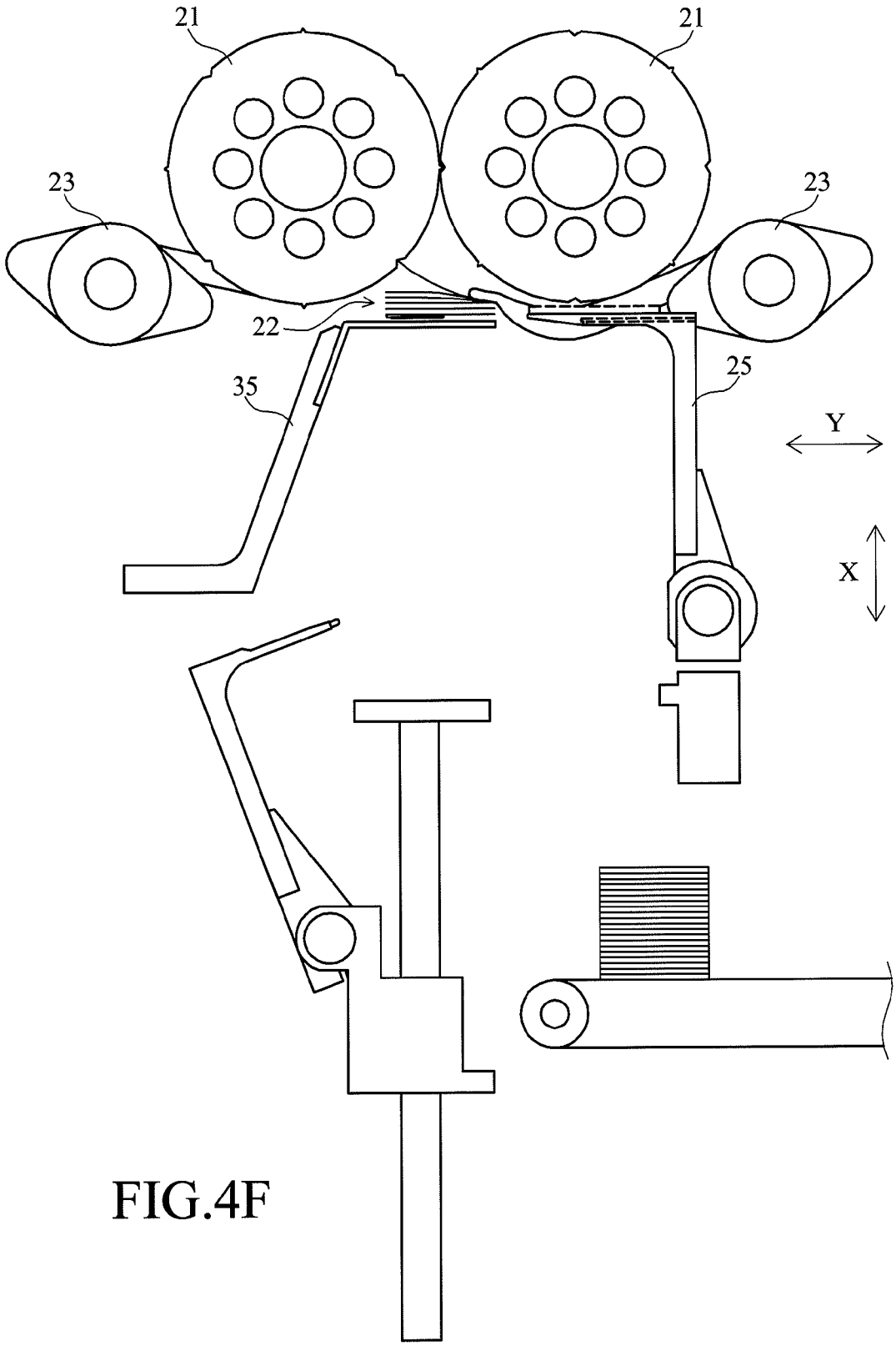

In one embodiment of the present invention, the web product folding and stacking machine 20 further comprises a second carrier unit 35 adapted to receive a stack of interfolded web products 22 from the first carrier unit 25. The second carrier unit 35 can be extended out along, for example, the second direction Y. The first carrier unit 25 will be retracted when the second carrier unit 35 is extended out, enabling the duly finished stack of interfolded web products 22 to be placed on the second carrier unit 35. When the duly finished stack of interfolded web products 22 is transferred from the first carrier unit 25 to the second carrier unit 35, the folding line making wheels 21 and the folding fingers 23 keep operating. Following increasing of the number of interfolded web products 22, the second carrier unit 35 is lowered along the first direction X, as shown in FIG. 4F.

Figure 4G:
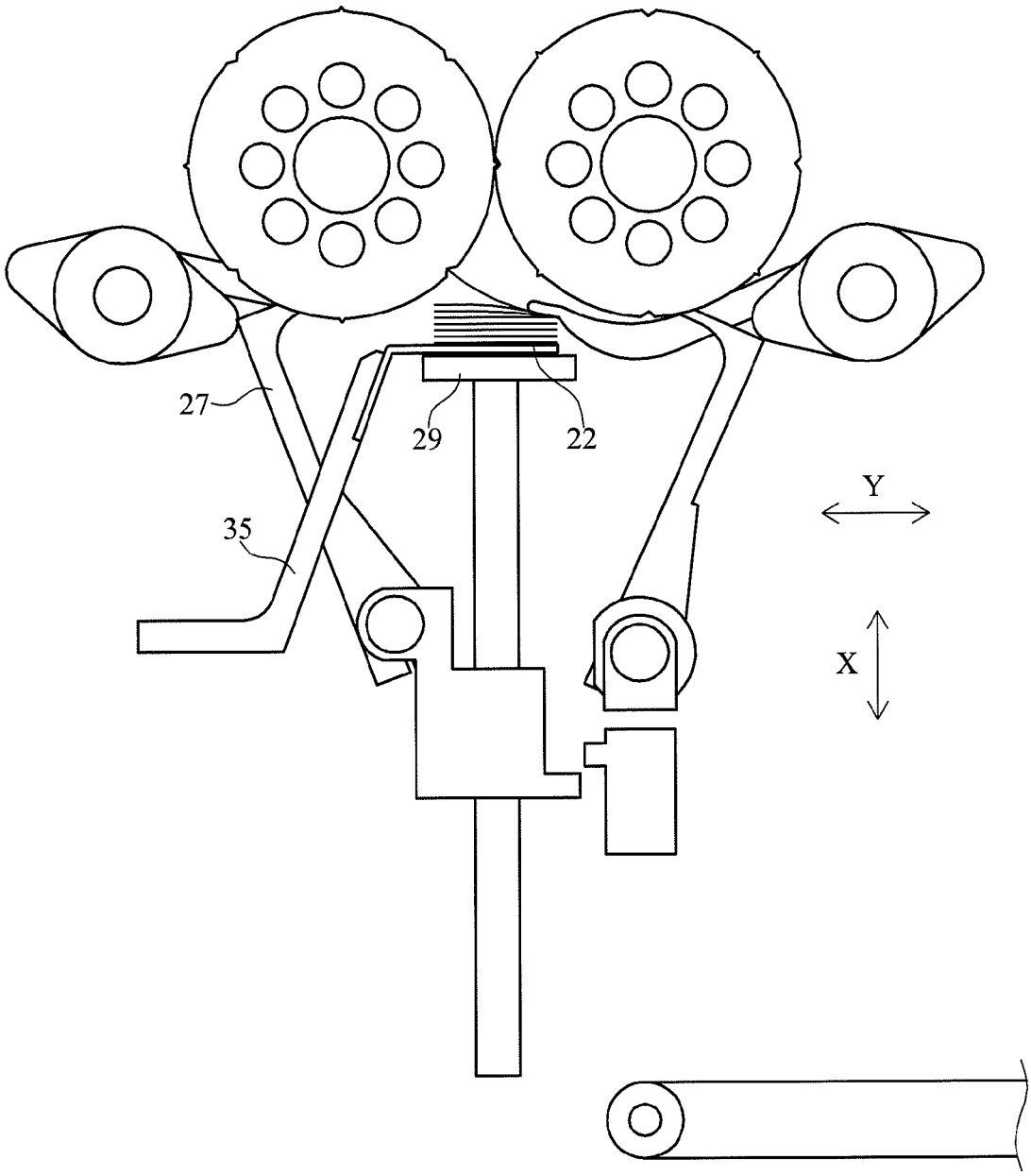

After delivery of one finished stack of interfolded web products 22 to the assigned location, the stoppage unit 27 and the holder 29 are moved upwards along the first direction X. When the holder 29 reaches the set position, the second carrier unit 35 is retracted along the second direction Y for enabling the holder 29 to receive folded web products 22 from the second carrier unit 35, and the stoppage unit 27 stands by for further web product separation operation. Further, following increasing of the thickness of the stack of interfolded web products 22 on the holder 29, the holder 29 is lowered along the first direction X, as shown in FIG. 4G. In another embodiment of the present invention, the web product folding and stacking machine 20 eliminates the aforesaid second carrier unit 35 and uses the holder 29 to receive the finished stack of interfolded web products 22 from the first carrier unit 25 directly.

In actual application, the folding line making wheels 21 and the folding fingers 23 can be operated to fold and stack web products 22 on the second carrier unit 35 and to let the finished stack of interfolded web products 22 be placed on the holder 29. Thus, the folding line making wheels 21 and the folding fingers 23 will fold up web products 22 on the holder 29 by means of continuously repeating the steps of FIGS. 4A~4G. Further, when the stoppage unit 27 is extended out to separate interfolded web products 22, the retractable member 271 is kept inside the stoppage unit 27, avoiding accidental damage to the interfolded web products 22. When the stoppage unit 27 is moved to deliver interfolded web products 22, the retractable member 271 is extended out of the stoppage unit 27 to hold down interfolded web products 22, keeping interfolded web products 22 neatly in a stack.

In actual application, the folding fingers 23, the first carrier unit 25, the stoppage unit 27 and/or the second carrier unit 35 can be fingers and be alternatively arranged at different elevations, facilitating folding, stacking, separation and/or delivery of web products 22.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A web product folding and stacking machine, comprising:

two folding line making wheels arranged in proximity to each other for transferring web products and causing each web product to form a folding line;

two folding fingers adapted to fold up each web products along the folding line thereof for enabling the web products to be stacked up in an interfolded condition;

a first carrier unit adapted for carrying the interfolded web products;

a stoppage unit adapted to isolate the interfolded web products, said stoppage unit being movable in a first direction;

a retractable member mounted in said stoppage unit and movable in and out of said stoppage unit; and a holder adapted to hold the interfolded web products, said holder being movable in said first direction.

2. The web product folding and stacking machine as claimed in claim 1, wherein said retractable member is extended out of said stoppage unit after movement of said stoppage unit along said first direction.

3. The web product folding and stacking machine as claimed in claim 2, further comprising an air blower unit adapted to blow air toward one said web product above said stoppage unit.

4. The web product folding and stacking machine as claimed in claim 1, wherein said first carrier unit has a suction device mounted therein for sucking one said web product, said suction device having a nozzle hole located on the bottom surface of said first carrier unit.

5. The web product folding and stacking machine as claimed in claim 4, further comprising a first folding unit and a second folding unit adapted to fold up one said web product that suspends from said first carrier unit.

6. The web product folding and stacking machine as claimed in claim 1, further comprising a second carrier unit adapted for receiving said web product from said first carrier unit.

7. The web product folding and stacking machine as claimed in claim 6, wherein said holder is adapted for holding the interfolded web products from said second carrier unit.

8. The web product folding and stacking machine as claimed in claim 1, wherein said first carrier unit has a pad mounted on a top surface thereof for carrying the interfolded web products.

9. The web product folding and stacking machine as claimed in claim 8, wherein said pad is elastic.

10. The web product folding and stacking machine as claimed in claim 1, wherein said holder is adapted to hold the interfolded web products from said first carrier unit.

11. A web product folding and stacking method used in the web product folding and stacking machine as claimed in claim 1, comprising the steps of:

forming a folding line on each of a plurality of web products and folding each said web product on said first carrier unit immediately after formation of the folding line;

operating said stoppage unit to isolate the interfolded web products when the number of the interfolded web products reaches a predetermined amount;

moving said stoppage unit and said holder to deliver the interfolded web products to a predetermined location; and extending said retractable member out of said stoppage unit.

12. The web product folding and stacking method as claimed in claim 11, further comprising a sub-step of operating an air blower unit to blow air toward one said web product above said stoppage unit.

13. The web product folding and stacking method as claimed in claim 11, further comprising a sub-step of moving said holder to receive the interfolded web products from said first carrier unit.

14. The web product folding and stacking method as claimed in claim 11, further comprising a first sub-step of using a second carrier unit to receive a stack of interfolded web products from said first carrier unit and a second sub-step of moving said holder to receive the stack of interfolded web products from said second carrier unit.

15. The web product folding and stacking method as claimed in claim 11, wherein said first carrier unit has a pad mounted on a top side thereof.

16. The web product folding and stacking method as claimed in claim 11, wherein said first carrier unit has mounted therein a suction device for sucking one said web product.

* * * * *